US009327881B1

(12) United States Patent
Saranga et al.

(10) Patent No.: US 9,327,881 B1
(45) Date of Patent: May 3, 2016

(54) ALL-IN-ONE LID DISPENSER

(71) Applicant: John J. Saranga, Lockport, IL (US)

(72) Inventors: John J. Saranga, Lockport, IL (US); Joseph A. Goetschel, Lockport, IL (US)

(73) Assignee: John J. Saranga, Lockport, IL (US)

( * ) Notice: Subject to any disclaimer, the term of this patent is extended or adjusted under 35 U.S.C. 154(b) by 0 days.

(21) Appl. No.: 13/904,966

(22) Filed: May 29, 2013

(51) Int. Cl.

| | |
|---|---|
| ***A47J 31/44*** | (2006.01) |
| ***B65D 43/02*** | (2006.01) |
| ***B31B 3/00*** | (2006.01) |
| *B65D 17/00* | (2006.01) |
| *B65D 41/34* | (2006.01) |

(52) U.S. Cl.
CPC ..... *B65D 43/0204* (2013.01); *B31B 3/00* (2013.01); *B65D 17/24* (2013.01); *B65D 41/3428* (2013.01)

(58) Field of Classification Search
CPC ..... B65D 43/0204; B65D 41/3428; B65D 41/3447; B65D 51/2842; B31B 3/00
USPC ..... 220/212; 222/83.5, 85, 145.1, 525, 222/541.2; 206/222
See application file for complete search history.

(56) References Cited

U.S. PATENT DOCUMENTS

| | | | | |
|---|---|---|---|---|
| 5,934,493 | A | 8/1999 | Han | |
| 5,979,647 | A | 11/1999 | Han | |
| 6,708,735 | B1 | 3/2004 | Kenihan | |
| 6,732,875 | B2 | 5/2004 | Smith et al. | |
| 6,976,578 | B1 | 12/2005 | Kenihan | |
| 7,175,042 | B2 | 2/2007 | Durdon | |
| D537,717 | S | 3/2007 | Notarianni | |
| 7,246,716 | B2 | 7/2007 | Durdon | |
| 7,337,921 | B2 | 3/2008 | Ma | |
| D592,952 | S | 5/2009 | Hundley et al. | |
| 7,819,271 | B2 | 10/2010 | Hollis et al. | |
| 8,016,159 | B2 | 9/2011 | Ma | |
| 8,070,014 | B2 | 12/2011 | Wisniewski | |
| 8,167,162 | B2 | 5/2012 | Levey | |
| 8,297,456 | B1 | 10/2012 | Anderson | |
| 8,376,135 | B1 | 2/2013 | Greenberg et al. | |
| 2002/0157970 | A1 | 10/2002 | Carlson | |
| 2011/0174642 | A1* | 7/2011 | Coon | 206/222 |

FOREIGN PATENT DOCUMENTS

| | | | |
|---|---|---|---|
| EP | 1293438 | A2 | 3/2003 |

OTHER PUBLICATIONS

Life Top Bericap, found at URL http://lifetop.eu/company/bericap, downloaded on May 29, 2013.
Patton, Phil, "The Coffee Lids Story-Updated Coffee Cup Lids", May 17, 2011, found at URL http://philpatton.typepad.com/my_weblog/2011/05/the-coffee-lids-story-updated.html, downloaded on May 29, 2013.

(Continued)

*Primary Examiner* — Fenn Mathew
*Assistant Examiner* — Elizabeth Volz
(74) *Attorney, Agent, or Firm* — Perkins IP Law Group LLC; Jefferson Perkins

(57) ABSTRACT

An All-In-One Lid Dispenser contains condiments and additives to be added to a beverage or food container. Raised sections on the top panel of the lid are depressed by the consumer which causes punches to separate the dispensing flaps from the bottom panel. The condiments or additives which are contained in between the top and bottom panels flow through the dispensing flap holes into the beverage or food.

29 Claims, 9 Drawing Sheets

(56) References Cited

OTHER PUBLICATIONS

Harpman, Louise et al., "Inventory / Peel, Pucker, Pinch, Puncture," Cabinet, Issue 19, Chance Fall 2005, found at URL http://www.cabinetmagazine.org/issues/19/harpman.php, downloaded on May 29, 2013.

Smith, K. Annabelle, "Design Decoded, The World's Largest Collection of Coffee Cup Lids," Nov. 15, 2012, found at URL http://blogs.smithsonianmag.com/design/2012/11/the-worlds-largest-collection-of-coffee-cup-lids/, downloaded on May 29, 2013.

Nicola, "Edible Geography, The Evolution of Lids," Edible Geography, Published May 9, 2011, found at URL http://www.ediblegeography.com/the-evolution-of-lids/, downloaded on May 29, 2013.

Steeman, Anton, "Best in Packaging, Worldwide innovations in packaging technology with a touch of greenness and an accent on sustainability and recyclability, Developments in Dispensing Caps—An Overview 03," Mar. 22, 2012, found at URL http://bestinpackaging.com/2012/03/22/developments-in-dispensing-caps-an-overview-03/, downloaded on May 29, 2013.

* cited by examiner

ALL-IN-ONE LID DISPENSER

BACKGROUND OF THE INVENTION

Many people enjoy water and other beverages and foods that have flavors or nutritional content enhanced by the addition of different additives. For example, coffee is a popular beverage consumed by millions, if not billions, of people each morning and throughout the day. A substantial number of these coffee drinkers choose to enhance the flavor of coffee by adding substances such as cream, milk, sugar or other sweeteners, and flavored syrups. Yet coffee is not the only beverage or food to which substances may be added. Liquid and powder additives are also added to water to create completely different beverages such as baby formula or energy drinks Liquid and powder additives such as lime juice and hot sauce are also often added to soups, chilis and other foods.

People may find it convenient and easy to mix additives into coffee or water or soup while stationary, but in today's society people are often on the go. Coffee, especially, is often grabbed at a coffee shop or drive through window in the morning. Having to grab the cup of coffee plus additional packets of creamers, sweeteners and sugar while rushing through the morning commute isn't easy or practical. Mixing the creamers, sweeteners and sugar to the cup of coffee while driving or walking may even be hazardous, leading to spills and possibly burns. In addition single serving size additive packages create additional waste. Thus a need exists for a lid for a beverage and food container that contains and dispenses additives into the container.

SUMMARY OF THE INVENTION

According to one aspect of the invention, a lid is provided which may be used to dispense additives into a beverage or food container. A lid body has a top panel with a general upper surface and is disposed around a vertical axis. The general upper surface has at least one raised section with at least one punch downwardly extending from the general lower surface of the top panel. A bottom panel is axially spaced from and opposed to the top panel with at least one dispensing flap formed in the bottom panel. The bottom panel dispensing flap is in axial registration with the respective raised portion and defined by weakened separation lines and a hinged portion. The additive is stored between the top and bottom panels. When pressure is applied to the raised portion, the lower end of the punch contacts the dispensing flap which separates from the remainder of the bottom panel. As a result, the additive is introduced into the container.

According to another aspect of the invention, the lid is provided that has a top panel with a raised arcuate track on the general upper surface of the top panel. A drinking hole, which is in direct communication with the beverage or food container, is disposed on the raised arcuate track. A slidable cover has mating rails that cooperate with channels on the raised arcuate track so that the cover is slidable between a closed drinking hole position and an open drinking hole position.

According to yet another aspect of the invention, the lid is formed by hinging together a top panel, a central panel and a bottom panel such that the general upper surface of the central panel is offset 180 degrees from the general upper surface of the top panel. The general upper surface of the bottom panel is offset 180 degrees from the general upper surface. The bottom panel is folded onto the central panel such that the general upper surface of the bottom panel is generally adjacent to the general lower surface of the central panel. The top panel is folded onto the central panel such that the general lower surface of the top panel is adjacent to the general upper surface of the central panel.

The present invention provides an advantage to dispensing beverages and foods with non-additive containing lids. The present invention reduces waste and provides a safer and more efficient process for introducing additives into beverages and foods while on the go. As an added advantage, there are many beverages that may be formed by using this invention such as baby formula and energy drinks.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
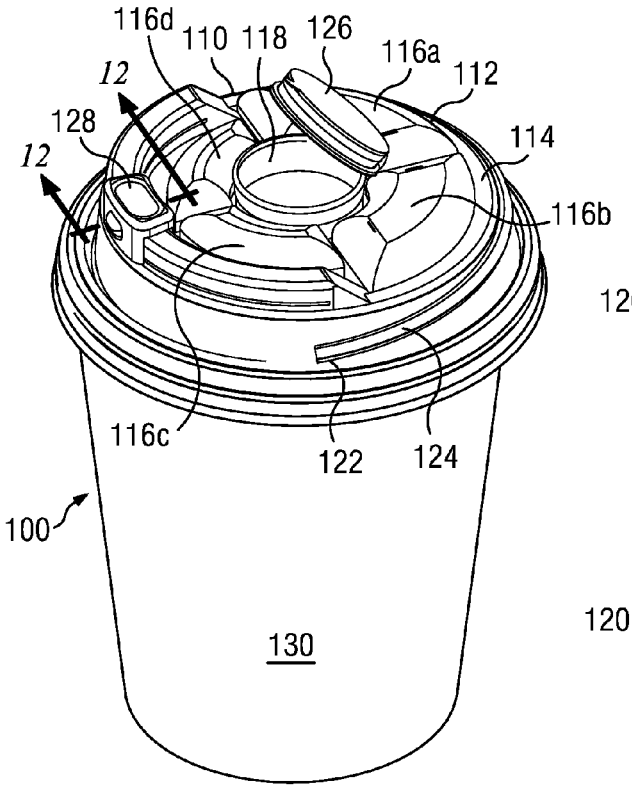
FIG. 1 is an isometric view of one embodiment of a lid according to the invention, connected to a beverage container.

The present invention provides a lid to be used in dispensing additives into a beverage or food container. In the embodiment shown in FIG. 1, a beverage or food container indicated generally at 100 includes a lid 110 and in this embodiment a beverage container 130. The lid is preferably formed from injection molded plastic but portions of it may be thermoformed or compression-molded from a plastic blank, and may instead be formed with coated paper. As shown in FIG. 1, the lid 110 fits on the container 130 to prevent spillage.

Figure 2:
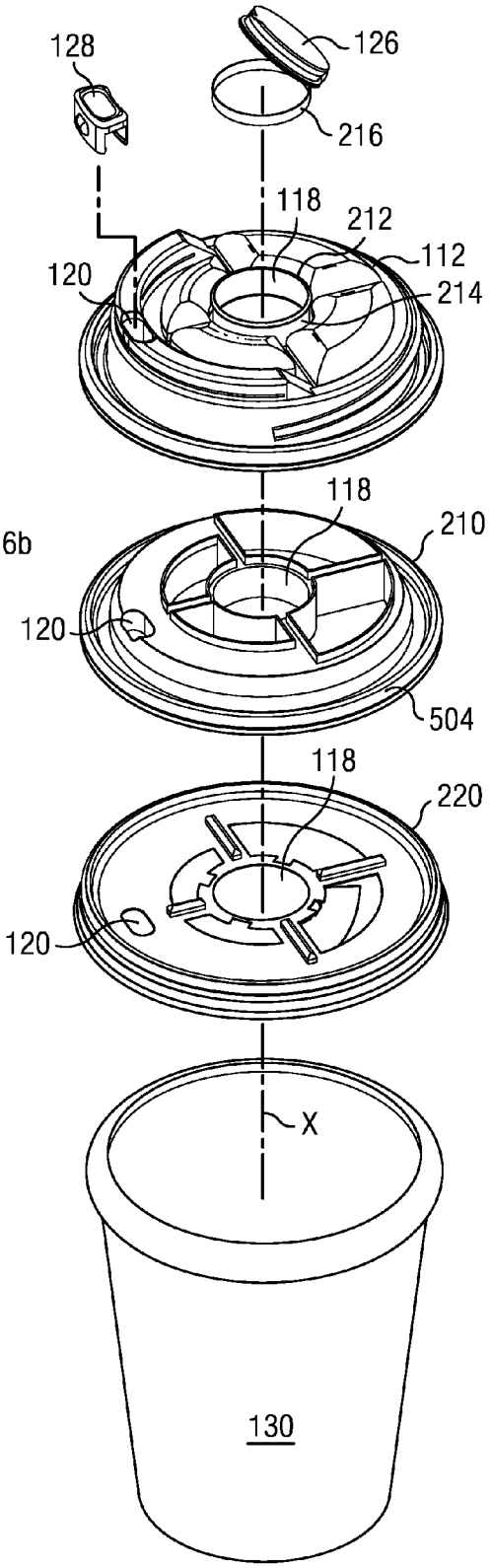
FIG. 2 is an exploded view of the lid and beverage container shown in FIG. 1.
Figure 3A:
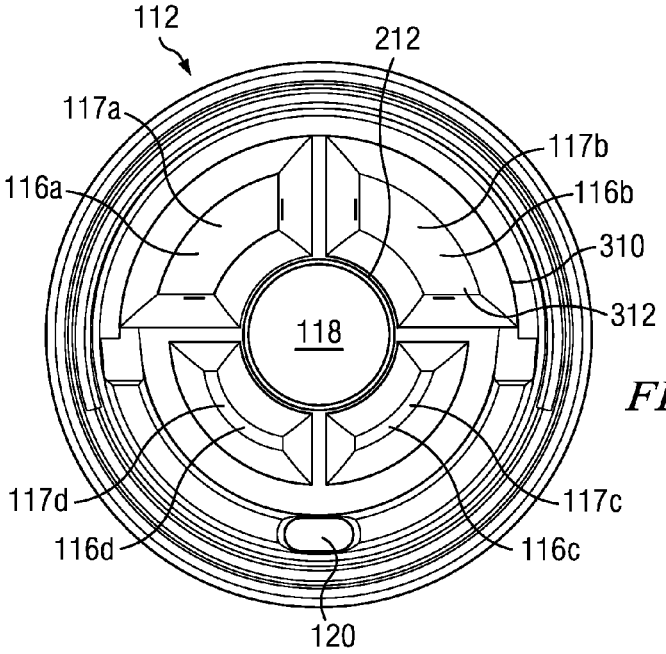
FIG. 3A is a plan view of a top panel of the lid shown in FIG. 1.

As illustrated in FIGS. 1 and 2, the lid 110 of the container has a top panel 112 with a general upper surface 114. At least one raised section 116*a* is on the general upper surface 114. The embodiment shown in FIG. 1 has four such raised sections 116*a*, 116*b*, 116*c*, 116*d*; in other embodiments, two, three, five or more raised sections may be provided. Raised sections may also have words such as "creamer," "sugar" and "sweetener" written or embossed on the respective horizontal and flat top areas 117*a*, 117*b*, 117*c* and 117*d* (FIG. 3A). As illustrated in FIG. 1, the raised sections 116*a*, 116*b*, 116*c*, 116*d*, have sides that are arcuate in two planes parallel to the vertical axis or are convex or dome-shaped on the sides with a generally flat top. Each of the raised sections 116 *a-d* are hollow and have walls which are sufficiently thin that downward pressure on their flat area 117*a*, 117*b*, 117*c* or 117*d* will cause a depression or buckling of the raised section.

According to one aspect of the invention, an access hole 118 communicates with the general upper surface 114. The access hole 118 provides direct communication to the food or beverage inside the container. In the embodiment illustrated in FIG. 1, the access hole 118 is radially inwardly displaced from the raised sections 116*a*, 116*b*, 116*c*, 116*d* and may be coaxial with an axis x of the lid and container. In the illustrated embodiment shown in FIG. 1, a stir stick 124 is releasably held by a stir stick notch 122. If desired, the stir stick 124 may be removed by the consumer and used to further mix the container contents via the access hole 118. The stir stick 124 and notch 122 may be disposed on the top panel 112 radially outward from the raised sections 116 *a-d*.

In the embodiment shown in FIG. 2, the lid 110 consists of the top panel 112, a central panel 210 and a bottom panel 220. In other embodiments the lid 110 may consist solely of a top panel 112 and a bottom panel 220. The access hole 118 is formed to extend through the top panel 112, central panel 210 and bottom panel 220. An access hole cover 126 may be attached to an upwardly extending lip 212 and sidewall 214 via a pressure fitted ring 216. A drink hole 120 is also disposed to communicate to the general upper surface 114 of the top panel 112. The drink hole 120 provides direct communication to the beverage inside the container and is formed through on the central panel 210 and bottom panel 220 as well as the top panel 112. As illustrated in FIG. 2, the drink hole 120 may be covered by a slidable cover 128. Drink hole 120 may be positioned to be radially outward from the access hole 118 and the raised sections 116 *a-d*; in other embodiments the drink hole 120 may be at about the same distance from axis x as the raised sections 116 *a-d*.

Figure 3B:
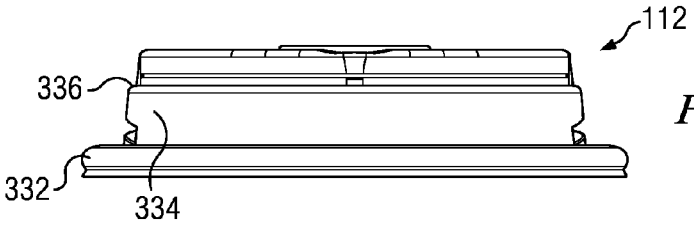
FIG. 3B is a side view of the top panel of the lid shown in FIG. 1.

FIG. 3A illustrates an embodiment of the top panel 112. In this embodiment the four raised sections 116*a*, 116*b*, 116*c*, 116*d* are disposed radially outwardly from the access hole 118. In further embodiments there may be one, two, three, five or more raised sections 116*a* with or without identification. FIG. 3B illustrates the side of the top panel 112. In each section 116 *a-d*, an outer boundary 310, is formed to be larger than and lower than a boundary 312 of the respective top flat area 117*a, b, c* or *d*. The outer boundary 310 is joined to the boundary 312 by one or more convex sections. Providing flat areas 117 *a-d* makes the raised sections 116 *a-d* more susceptible to buckling when downward pressure is applied to the section by a user's finger.

Figure 3C:
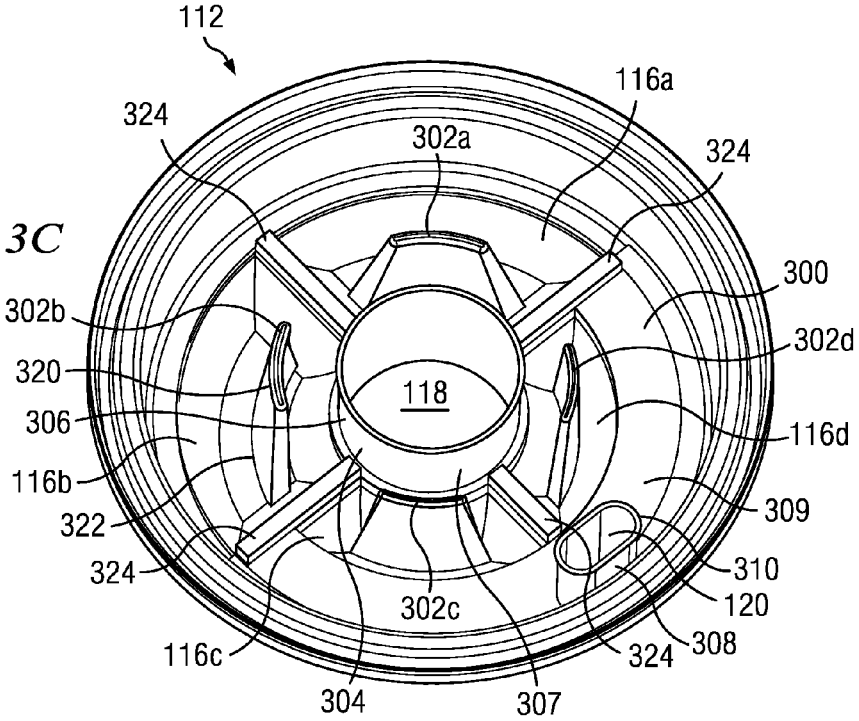
FIG. 3C is a bottom isometric view of the top panel of the lid.

FIG. 3C illustrates an embodiment of the underside of the top panel 112. In this embodiment, the top panel 112 has four raised sections 116*a*, 116*b*, 116*c*, 116*d* as illustrated in FIG. 3A and a general lower surface 300 of the top panel 112 is shown. At least one punch downwardly extends perpendicularly from the lower surface of each raised section 116*a*, 116*b*, 116*c*, 116*d*. In the illustrated embodiment four spaced-apart punches 302*a*, 302*b*, 302*c*, 302*d* downwardly extend generally perpendicularly from the general lower surface 300 of each raised section. Further embodiments may have one or more punches either per raised section or in total. Each of the punches 302*a*, 302*b*, 302*c*, 302*d*, as illustrated in FIG. 3C, are hollow and have a shape with a nonplanar right radial cross-section (that is, a cross section perpendicular to axis x). In the illustrated embodiment the punches 302*a*, 302*b*, 302*c*, 302*d* are shown with arcuate curve across a radial cross section. Other embodiments may include punches that are solid, have circular cross-sections or a radial cross-section with sharp corners. Punches 302*a-d* are thick enough that they will not buckle under a columnar load placed on them from above. Each punch 302*a, b, c* and *d* occupies a relatively small area (such as about 10%) of the bottom surface of the respective raised section 116 *a, b, c* or *d* from which it depends; the rest of the raised section has a relatively thin wall which will therefore buckle first. In this embodiment, each punch 302*a-d* is aligned with a respective flat area 117 *a-d*, such that downward pressure by a finger on a flat area will result in a direct downward load that will be directly transmitted to the punch.

FIG. 3C further illustrates an embodiment in which a coaxial tube 304 extends from the access hole disposed on the general upper surface 114 of the top panel 112. The tube 304 has a free end with a locking lip 306 which takes the form of an annulus which extends radially outwardly from the tube sidewall 307. When assembled, the tube 304 and locking lip 306 extend through the bottom panel 220 and aid in providing support to the lid structure. In this embodiment, the tube 304 is in direct communication with the general volume of the container 130. In one embodiment, the tube 304 and locking lip 306 may extend through both the central panel 210 and the bottom panel 220.

FIG. 3C further illustrates an embodiment in which a drinking tube 308 extends from the drink hole 120 disposed on the general upper surface 114 of the top panel 112. The tube 308 which is downwardly dependent from the general lower surface 309 of the top panel 112, has a horizontally outwardly extending locking lip 310 which also extends through the bottom panel 220 and aids in providing support to the lid structure. In this embodiment, the tube 308 is in direct communication with the general volume of the beverage container 130. In one embodiment, the tube 308 and locking lip 310 may extend through the central panel 210 and the bottom panel 220. As also seen in FIG. 3C, each punch 302*a-d* has a lower end 320 which is smaller in cross-sectional area than its upper end 322. This focuses the downward force transmitted by e.g. punch 302*a* onto flap 402*a* (FIG. 4) as will be explained below. The raised sections 116 *a-d* (appearing as concavities in this bottom view) are separated by radially disposed ribs 324, which help soften the lid and ensure that each raised section will buckle or collapse selectively rather than downward pressure causing a general collapse of the lid.

Figure 3D:
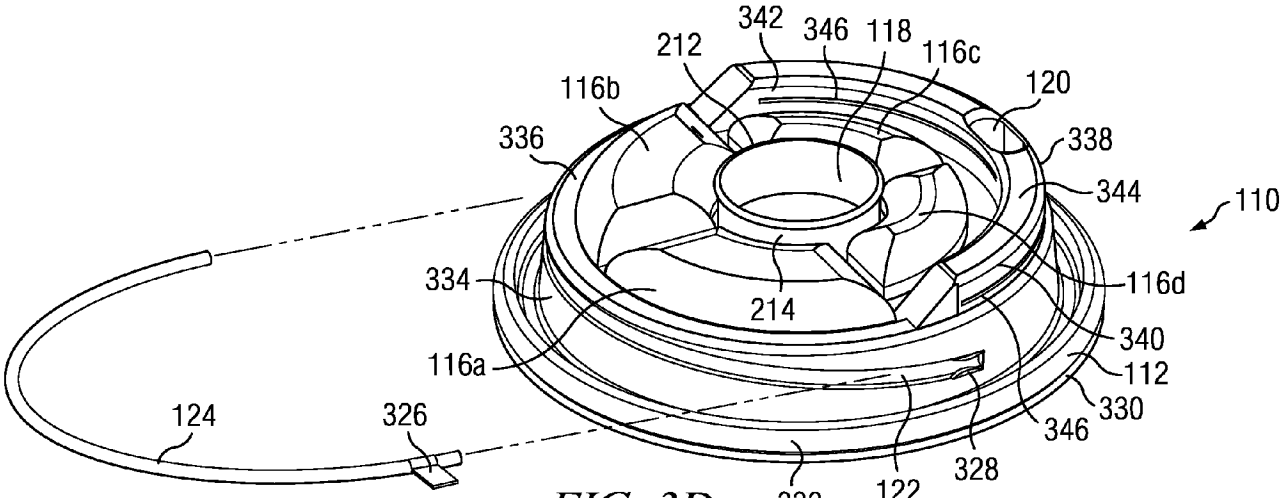
FIG. 3D is an exploded view of a lid top panel showing the relationship between a stir stick and a stir stick notch.

In the embodiment illustrated in FIG. 3D, the stir stick 124 removal may be accomplished by pulling a tab 326 attached near one end of the stir stick 124. When in place, the stir stick 124 is secured in the stir stick notch 122 by protrusions 328. The stir stick notch 122 is radially outwardly displaced from the raised sections 116*a*, 116*b*, 116*c*, 116*d*. The top panel 112's outer margin 330 is finished with a raised snap seal or hollow rib 332. Rib 332 is circumferential and presents a downwardly open hollow channel to the central panel (described below). Radially inwardly from snap seal 332, there can be a raised frustoconical wall 334, into which is formed the stir stick notch 122. Wall 334 terminates at its upper end in a plateau 336, on which are formed raised sections or additive chambers 116 *a-d* and a raised arcuate track 338.

FIG. 3D also shows a raised arcuate track 338 formed on the top panel of the lid 112. The raised track 338 is disposed between the outer margin 330, top panel 112 and raised sections 116*a* and 116*c*, and has an outer side 340 and inner side 342 and a top panel 344 joining the outer and inner sides 340, 342. A drinking hole 120 is formed through the top panel 344 of the raised arcuate track 338. The arcuate track 338 has channels 346 that are formed along the outer and inner sides 340, 342. A drinking hole cover 128 (FIG. 11) has an interior surface 1106 that has mating rails 1104 that cooperate with the respective ones of the track channels 346. The drinking hole cover 128 slides between positions where the drinking hole 120 is open and closed. In the illustrated embodiment arcuate track 338 occupies an angular sector around axis x which is much greater than the sector occupied by drinking hole 128, extending to either side of it. This permits cover 128 to be slid to either side of drink hole 128 to gain access to drink hole 128.

Figure 4:
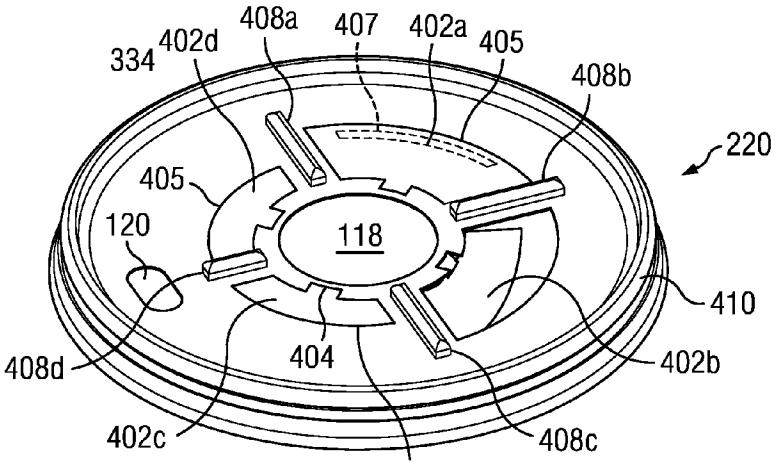
FIG. 4 is a top isometric view of a bottom panel of the lid shown in FIG. 1.

FIG. 4 illustrates a bottom panel 220 of the lid 110. At least one dispensing flap is formed on the bottom panel 220; in the illustrated embodiment four dispensing flaps 402*a*, 402*b*, 402*c*, 402*d* are formed on the bottom panel 220. Other embodiments may have one, two, three, five or more dispensing flaps 402*a*. Each dispensing flap 402*a*, 402*b*, 402*c*, 402*d* is in axial registration with a respective one of the raised sections of the top panel 116*a*, 116*b*, 116*c*, 116*d*. Each dispensing flap 402*a*, 402*b*, 402*c*, 402*d* is defined by weakened separation lines 406 and a hinge portion 404. Each separation line includes an outer arc 405 opposite the hinge 404. In the embodiment illustrated in FIG. 4, the hinged portion 404 is disposed on the side of the dispensing flap 402*b* which is closest to the access hole 118. In addition, the one or more punches 302*a*, 302*b*, 302*c*, 302*d* are positioned such that each punch engages the respective dispensing flap in an area shown by dotted line 407, remote from the respective hinge 404 of the dispensing flap 116*a*, 116*b*, 116*c*, 116*d*, and near arc 405. In this way the leverage from the punch 302*a*, 302*b*, 302*c*, 302*d* is maximized and will allow the dispensing flap 402*a, b, c* or *d* to have an easy and clean break from the bottom panel. Bottom panel 220 has a margin which includes a raised circumferential rib 410 that engages a circumferential snap seal of central panel 210, as will be described below.

Additives such as creamer, sugar and sweetener are stored between the top panel 112 and bottom panel 220 in a plurality of reservoirs formed between the raised sections 116*a*, 116*b*, 116*c*, 116*d* of top panel 112 and the respective dispensing flaps 402*a*, 402*b*, 402*c*, 402*d*. When one of the raised sections of the top panel, for example 116*a*, is depressed, the punch 302*a* contacts the dispensing flap 402*a* and separates the dispensing flap from the remainder of the bottom panel 220 along the weakened separation lines 406. The dispensing panel 402*a* is deflected downward and the additive falls or flows into the beverage container 130. The hinge portion 404 prevents the dispensing flap 402*a* from falling into the container 130. Importantly, although some embodiments may have more than one raised section 116*a* with more than one additive, the consumer can choose to add only the additives desired and the remaining additives will not exit the respective reservoirs.

Figure 5A:
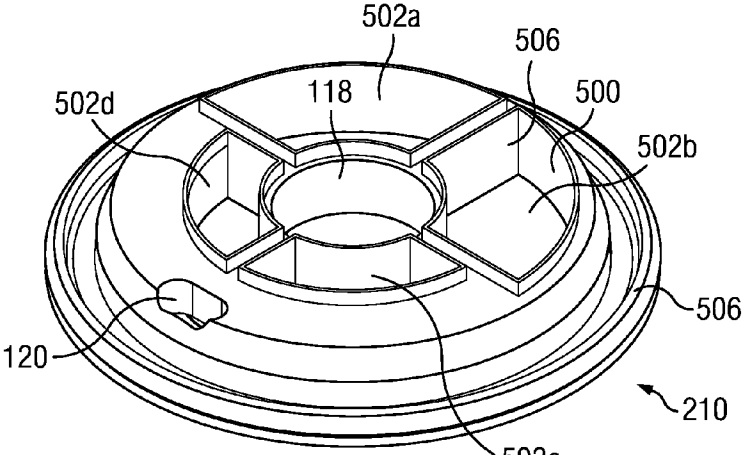
FIG. 5A is a top isometric view of a central panel of the lid as shown in FIG. 2.
Figure 5B:
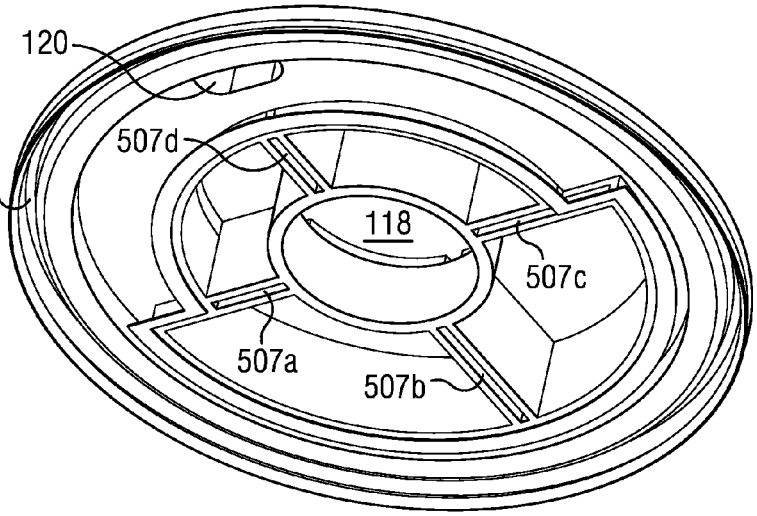
FIG. 5B is a bottom view of the central panel shown in FIG. 5A.
Figure 5C:
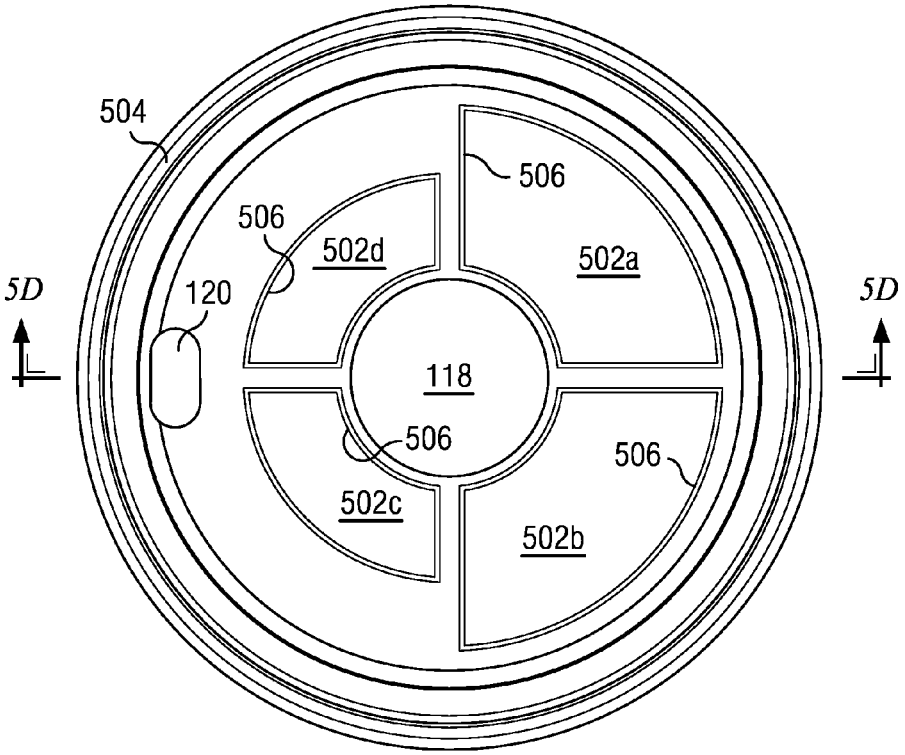
FIG. 5C is a top view of the central panel shown in FIG. 5A.
Figure 5D:
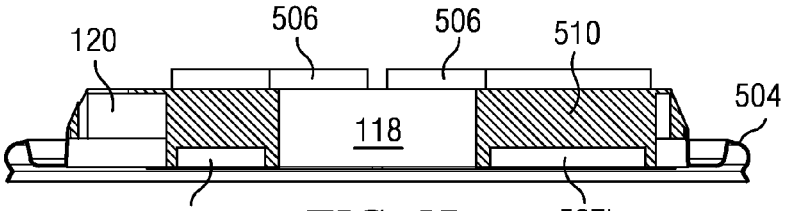
FIG. 5D is a cross-sectional view taken substantially along the line 5D-5D of FIG. 5C.

Some embodiments of the lid may include a central panel 210 illustrated in FIG. 5A. As shown in FIG. 2, the central panel 210 is interposed between the top panel 112 and bottom panel 220. Central panel 210 furnishes sidewalls for at least one dispensing reservoir. In the illustrated embodiment shown in FIGS. 5A and 5B, there are four dispensing reservoirs 502*a*, 502*b*, 502*c*, 502*d*. Each reservoir 502 has sidewalls 506 that extend between the top panel 112 and bottom panel 220. Sidewalls 506 will closely fit inside ribs 324 (FIG. 3C) and will extend between access hole tube 307 and top panel sidewall 334 (FIG. 3D). In embodiments where there is a central panel 210 disposed between the top panel 112 and the bottom panel 220, the additives may be stored in reservoirs 502*a*, 502*b*, 502*c*, 502*d* formed by raised sections 116*a-d* and sidewalls 506.

In the illustrated embodiment of FIGS. 3-5, the central panel connects to both the top and bottom panels. In the embodiment illustrated in FIG. 5A-5C a top snap seal 504 upwardly extends from the outer perimeter of the central panel 210. This seal connects to rib 332 of the top panel 112. Seal 504 also snaps over raised rib 410 of the bottom panel 220. In some embodiments, the seal 504 may be heat sealed to the raised rib 410. As illustrated in FIG. 4, the bottom panel has raised connecting walls or ribs 408*a*, 408*b*, 408*c* 408*d* disposed in between the dispensing flaps 402*a*, 402*b*, 402*c*, 402*d*. The raised connecting walls 408*a*, 408*b*, 408*c*, 408*d* are sized to fit into the slots 507*a*, 507*b*, 507*c*, 507*d* disposed on the underside of the central panel 210, further connecting the bottom panel 220 to the central panel 210.

Figure 6A:
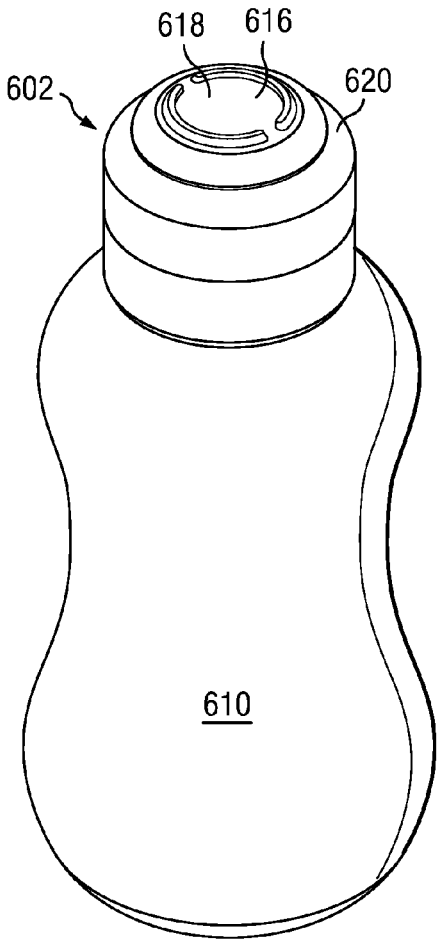
FIG. 6A is an isometric view of a second embodiment of a lid according to the invention, used in connection with a baby bottle.
Figure 6B:
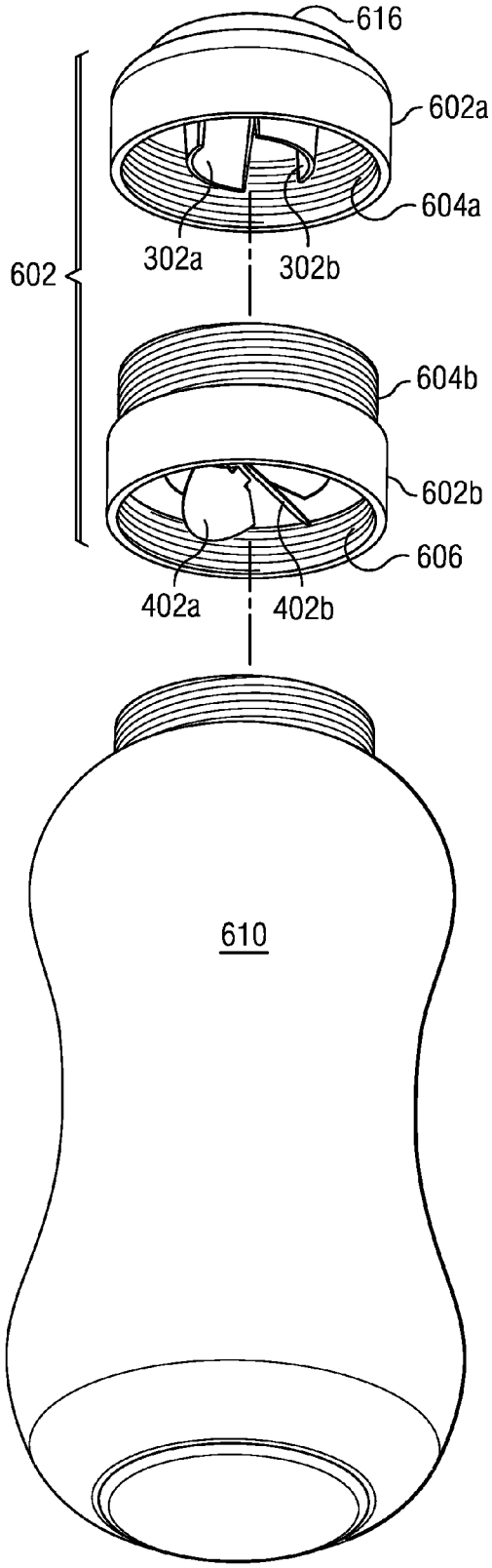
FIG. 6B is an exploded view of the embodiment shown in FIG. 6A.

FIG. 6A illustrates a further embodiment of the invention where a lid or top 602 is used on a bottle 610 such as a baby bottle. As shown in FIG. 6B, in one embodiment the lid 602 may be separable into two pieces 602*a*, 602*b*. In the embodiment illustrated in 6B, the lid 602 has two threaded connectors 604*a*, 604*b*, 606. The first threaded connector 604*a* and 604*b* attaches the two pieces of the lid 602*a*, 602*b* to each other. The second threaded connector 606 attaches the lid to the baby bottle 610. In further embodiments the lid pieces 602*a*, 602*b* may be fastened to each other by other means such as glue, snapping together or being heat fused. In the alternative embodiment illustrated in FIG. 6E the threads may be replaced with rubber rings 608.

Figure 6C:
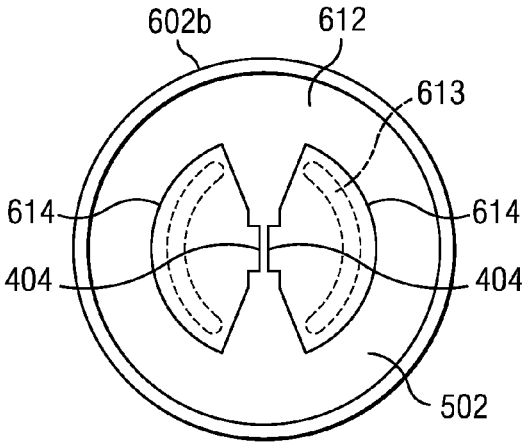
FIG. 6C is a plan view of a bottom panel of the lid shown in FIG. 6A.
Figure 6D:
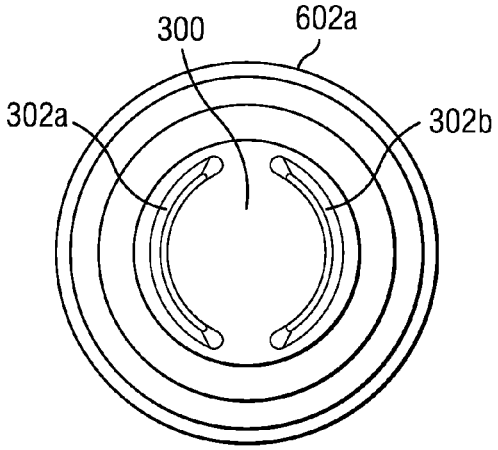
FIG. 6D is a bottom view of a top panel of the lid shown in FIG. 6A.
Figure 6E:
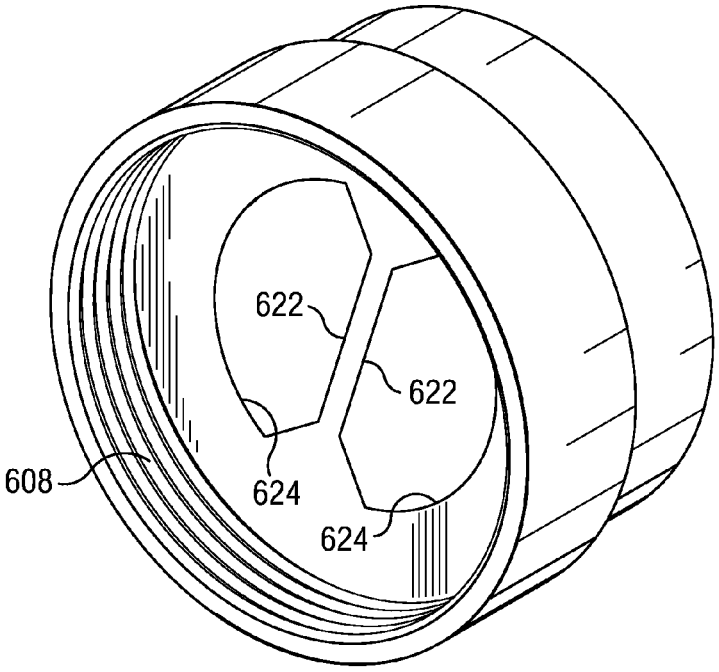
FIG. 6E is an isometric view of the lid shown in FIG. 6A.

The embodiment illustrated in FIGS. 6C and 6D, the lid 602*a, b* has one reservoir 502 with two punches 302*a*, 302*b* downwardly extending from the general lower surface 300 of the top member or panel 602*a*. The punches 302*a*, 302*b* are in registration with the two dispensing flaps 402*a*, 402*b* on the bottom panel 612 as illustrated in FIG. 6C. In this embodiment the hinges 404 of the dispensing flaps 402 are adjacent to each other in the center of the bottom panel 612. FIG. 6E shows another form of hinges 622 and weakened lines 624. As before, the punches 302*a*, 302*b* are arcuate and land on a "footprint" shown in dotted line at 613 in FIG. 6C. the punches 302*a* and 302*b* land on the flaps 402*a*, 402*b* near their outer arcuate weakened lines 614, and relatively remotely from the hinges 404. This embodiment replaces the multiple raised sections 116 *a-d* (FIGS. 1-3D) with a single raised section or dome 616. Raised section 616 has a relatively thin and flexible wall, a central flat portion 618 from which punches 302*a*, 302*b* depend, and a peripheral convex sidewall 620. Flat area 618 and convex sidewall 620 will aid in the selective buckling of raised section 616 upon a thumb or finger being pressed on flat area 618, thereby driving punches 302*a*, 302*b* onto flaps 402*a*, 402*b*.

Figure 11:
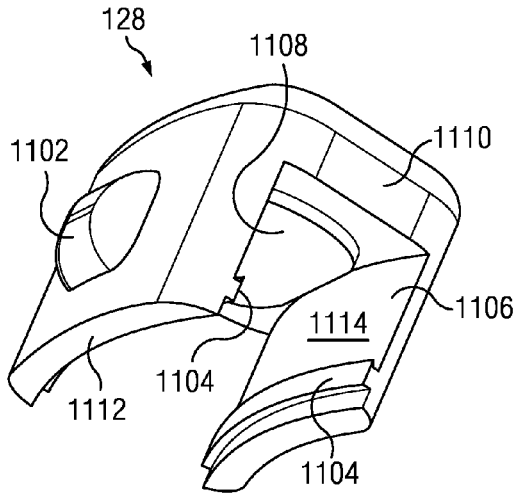
FIG. 11 is a detail view of a drinking hole cover shown in FIGS. 1 and 2.
Figure 12:
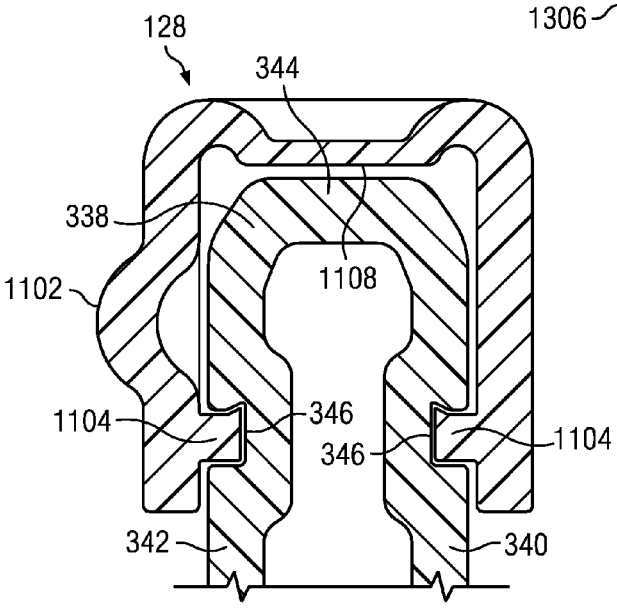
FIG. 12 is a cross-sectional detail showing a drink hole cover mounted on an arcuate track.

In further embodiments, as shown in FIGS. 11 and 12, the lid cover 128 may have a thumb tab 1102 extending radially from the outer side of the cover 128. The thumb tab 1102 may be used to slide the cover to different positions. Cover 128 may also have a boss 1108 which downwardly extends from top web 1110. Cover 128 has outer and inner arcuate sidewalls 1112, 1114 on which rails 1104 are formed to inwardly extend toward each other.

Figure 8:
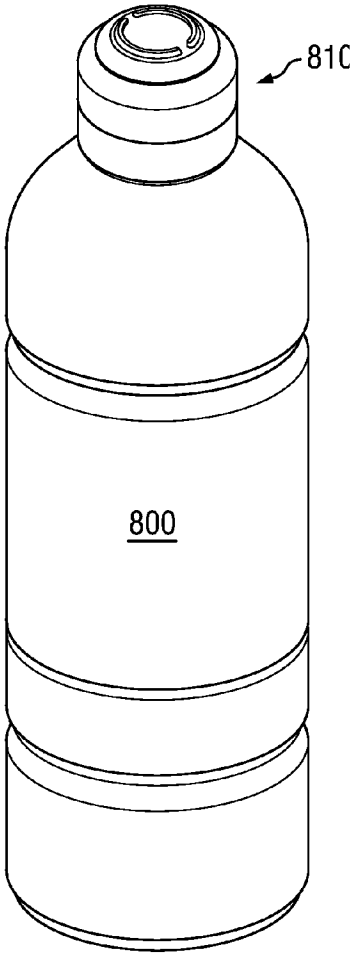
FIG. 8 is an isometric view of a lid according to the invention, closing a water bottle.

Yet a further embodiment of the invention is shown in FIG. 8. In this embodiment the dispensing lid 810 is placed on a water bottle 800. The additive contained in the lid 810 may be a powder or liquid energy drink mix, fruit punch mix, lemonade or one of a variety of other additives. The interior structure of lid 810 can be similar to lid 602*a*, 602*b*.

Figure 9:
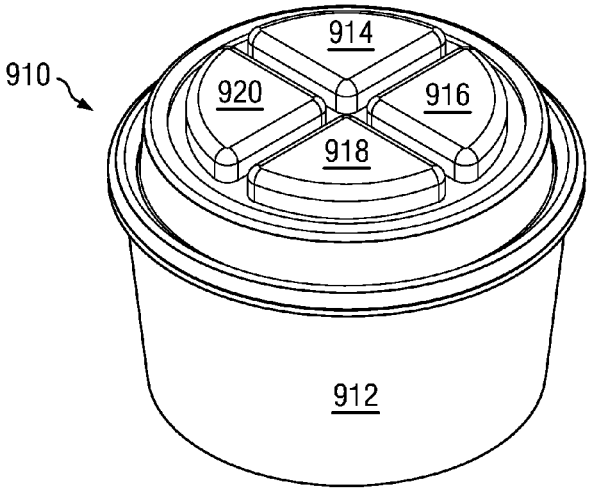
FIG. 9 is an isometric view of a lid according to the invention, fitted on a soup container.

Yet a further embodiment of the invention is shown in FIG. 9. In this embodiment the lid 910 contains additives that may be added to a soup or hot meal contained in container 912, such as hot sauce, lime flavorings, salt and pepper. A similar dispensing lid 810 or 910 may be also used to dispense alcoholic additives into a base substance such as water, soda, mixers, ice cream or yogurt. Lid 910 has four raised sections 914, 916, 918, 920 that are similar in their properties to raised sections 116 *a-d* shown in FIGS. 1-3D. Each raised section 914, 916, 918, 920 is equipped with a downwardly depending punch (not shown) that will selectively break open a hinged flap (not shown) to introduce the condiment or additive into the soup or other food or beverage contained in container 912. Lid 910, however, omits a stirring access hole or a drink hole.

Figure 10A:
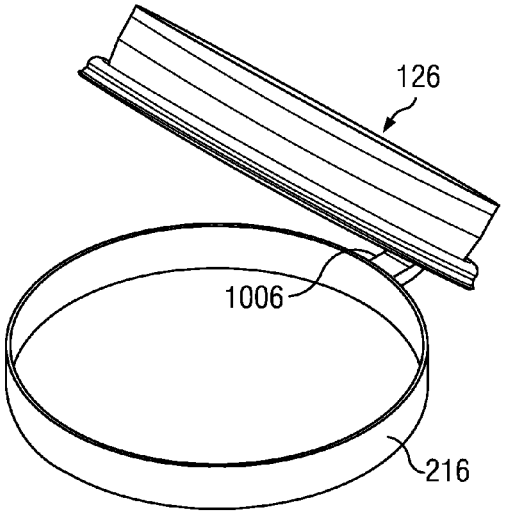
FIG. 10A is an isometric view of an access lid cover according to the invention.
Figure 10B:
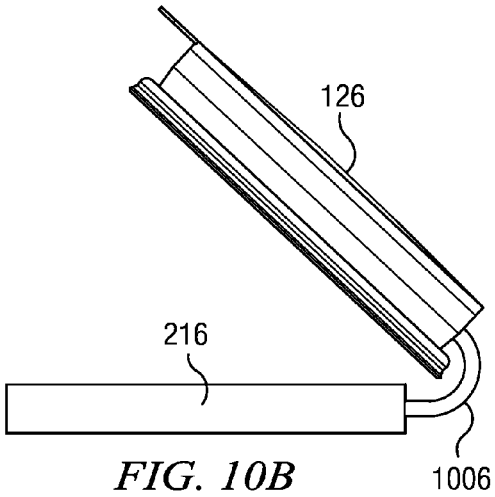
FIG. 10B is a side view of the access lid cover shown in FIG. 10A.

FIGS. 10A and 10B illustrate the pressure fitted ring 216 that may be connected to the access hole cover 126 via a flexible hinge 1006. The pressure fitted ring 216 may be placed around the upstanding lip 214 that extends upwardly from the access hole 118 (FIGS. 1-3D).

Figure 7:
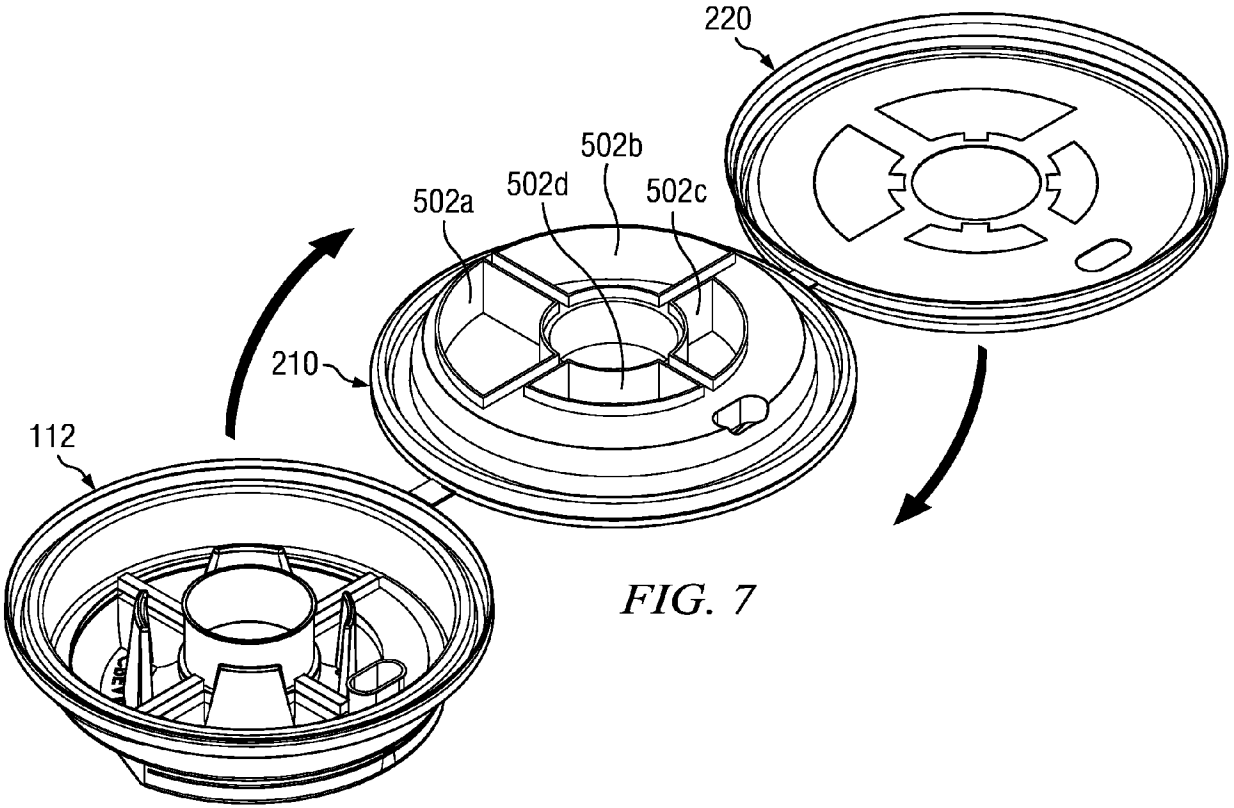
FIG. 7 is isometric view of folding panels that make up the lid shown in FIG. 1.
Figure 13:
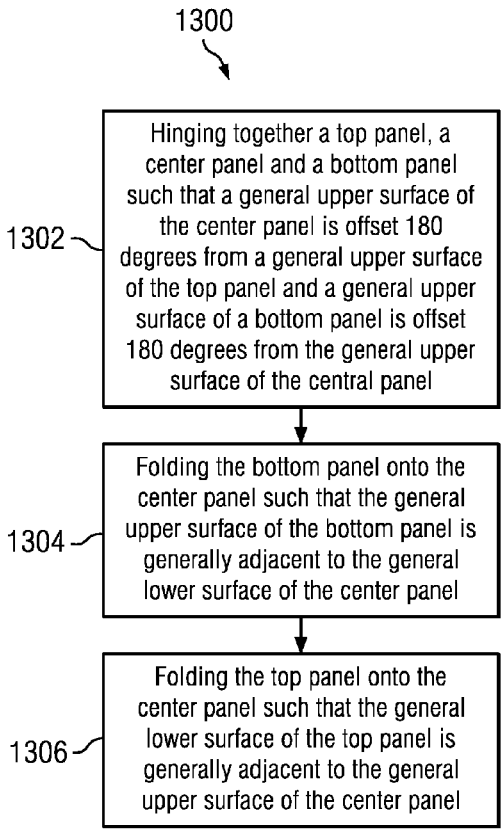
FIG. 13 is a schematic block diagram showing the steps for forming a lid assembly according to the invention.

FIG. 13 illustrates a further aspect of the invention in which a method 1300 for forming a lid assembly for use in dispensing condiments is accomplished by hinging together 1302 a top panel 112, a central panel 210 and a bottom panel 220 such that a general upper surface of the central panel is offset 180 degrees from a general upper surface of the top panel and a general upper surface of the bottom panel is offset 180 degrees from the upper surface of the central panel. As shown in FIG. 7, this means that at the start of an assembly sequence, central panel will be face-up and top and bottom panels will be facedown. The process folds 1304 the bottom panel 220 under the central panel 210 such that the general upper surface of the bottom panel 220 is generally adjacent to the general upper surface of the central panel 210. After bottom panel 220 has been folded into registration with the lower surface of central panel 210 and sealed to it, condiments or additives can be added to the reservoirs 502*a-d*. Then the next step is to fold 1306 the top panel 210 onto the central panel such that the general lower surface of the top panel 112 is generally adjacent to the general upper surface of the central panel 210.

In summary, lids have been shown and described which dispense additives into a beverage container. While illustrated embodiments of the present invention have been described and illustrated in the appended drawings, the present invention is not limited thereto but only by the scope and spirit of the appended claims.

We claim:

1. A lid for use in dispensing at least one additive into a beverage or food container, the lid comprising:

a lid body having a top panel with a general upper surface, the lid body disposed around a vertical axis, the general upper surface having at least one raised section, said at least one raised section having a general lower surface, at least one punch downwardly extending generally perpendicularly from the general lower surface; and a bottom panel axially spaced from and opposed to the top panel, at least one dispensing flap formed in the bottom panel and in axial registration with said at least one raised section, said at least one dispensing flap defined by weakened separation lines and a hinge portion, at least one additive stored between the top panel and the bottom panel, a lower end of the punch adapted, upon pressure being applied to the raised section of the general upper surface, to contact the dispensing flap, separate the dispensing flap from a remainder of the bottom panel along the weakened separation lines and downwardly deflect the dispensing flap around the hinge portion, thereby introducing the at least one additive into the beverage or food container, the lid further including a drinking hole disposed on the general upper surface of the top panel, the drinking hole being in direct communication with the beverage or food container.

2. The lid of claim 1, wherein a radial cross-section of said at least one punch has a non-planar shape.

3. The lid of claim 2, wherein the radial cross-section of said at least one punch is curved.

4. The lid of claim 1, and further including a tube that extends from the drinking hole disposed on the general upper surface of the top panel, the tube ending in a locking lip, the tube and the locking lip extending through the bottom panel, the tube being in direct communication with the beverage or food container.

5. The lid of claim 4, wherein the tube downwardly depends from the general lower surface of the top panel.

6. The lid of claim 1, and further including a tube that extends from the drinking hole disposed on the general upper surface of the top panel, the tube ending in a locking lip, the tube and the locking lip extending through the central panel and the bottom panel, the tube being in direct communication with the beverage or food container.

7. The lid of claim 6, wherein the tube downwardly depends from the general lower surface of the top panel.

8. The lid of claim 1, and further including a slidable cover for closing the drinking hole where the cover is slidable between a first open position and a second closed position.

9. A lid for use in dispensing at least one additive into a beverage or food container, the lid comprising:

a lid body having a top panel with a general upper surface, the lid body disposed around a vertical axis, the general upper surface having at least one raised section, said at least one raised section having a general lower surface, at least one punch downwardly extending generally perpendicularly from the general lower surface; and a bottom panel axially spaced from and opposed to the top panel, at least one dispensing flap formed in the bottom panel and in axial registration with said at least one raised section, said at least one dispensing flap defined by weakened separation lines and a hinge portion, an additive stored between the top panel and the bottom panel, a lower end of the punch adapted, upon pressure being applied to the raised section of the general upper surface, to contact the dispensing flap, separate the dispensing flap from a remainder of the bottom panel along the weakened separation lines and downwardly deflect the dispensing flap around the hinge portion, thereby introducing the at least one additive into the beverage or food container, the lid further including an access hole disposed on the general upper surface of the top panel, the access hole being in direct communication with the beverage or food container.

10. The lid of claim 9, wherein the access hole is radially inwardly displaced from the said at least one raised section.

11. The lid of claim 9, and further including a tube that extends from the access hole disposed on the general upper surface of the top panel, the tube ending in a locking lip, the tube and the locking lip extending through the bottom panel, the tube being in direct communication with the beverage or food container.

12. The lid of claim 11, wherein the tube downwardly depends from the general lower surface of the top panel.

13. The lid of claim 9, and further including an upstanding lip and sidewall that extend upwardly from the access hole.

14. The lid of claim 13, and further including a cover that fits over the access hole.

15. The lid of claim 14, wherein the access hole cover includes a pressure fitted ring placed around the upstanding sidewall and further includes a connecting cap that snaps onto the upstanding lip.

16. A lid for use in dispensing at least one additive into a beverage or food container, the lid comprising:

a lid body having a top panel with a general upper surface, the lid body disposed around a vertical axis, the general upper surface having at least one raised section, said at least one raised section having a general lower surface, at least first and second spaced-apart punches extending generally perpendicularly from the general lower surface; and a bottom panel axially spaced from and opposed to the top panel, at least one dispensing flap formed in the bottom panel and in axial registration with said at least one raised section, said at least one dispensing flap defined by weakened separation lines and a hinge portion, an additive stored between the top panel and the bottom panel, a lower end of the punch adapted, upon pressure being applied to the raised section of the general upper surface, to contact the dispensing flap, separate the dispensing flap from a remainder of the bottom panel along the weakened separation lines and downwardly deflect the dispensing flap around the hinge portion, thereby introducing the at least one additive into the beverage or food container.

17. The lid of claim 16, and further including at least one dispensing reservoir disposed between the top and bottom panels, the lid further including a central panel interposed between the top and bottom panels, a plurality of sidewalls of said at least one dispensing reservoir defined by the central panel.

18. The lid of claim 16, wherein the at least first and second punches are nonplanar and hollow, the radial cross-section of the at least first and second punches each having a non-planar shape.

19. The lid of claim 16, wherein the radial cross-sections of said at least first and second punches are curved.

20. The lid of claim 16, wherein at least two dispensing flaps are formed in the bottom panel, each of said at least first and second punches being disposed such that each of the first and second punches engaging a respective one of said dispensing flaps in an area remote from the hinge portion of the respective dispensing flap.

21. The lid of claim 16, wherein said raised section has sides which, when viewed from above the lid, are convex.

22. The lid of claim 16, and further including an elongate stir stick notch formed in the lid body to be radially outwardly displaced from the at least one raised section.

23. The lid of claim 22, and further including an elongate stir stick releasably attached to the stir stick notch.

24. The lid of claim 23, wherein the stir stick has two ends, a tab attached to the stir stick near one of the ends.

25. The lid of claim 16, and further including at least first and second spaced-apart raised sections formed in the general upper surface and each having a general lower surface, the first punch downwardly extending perpendicularly from the general lower surface of the first raised section, the second punch downwardly extending perpendicularly from the general lower surface of the second raised section.

26. The lid of claim 25, and further including at least first and second spaced-apart dispensing flaps formed in the bottom panel and in axial registration with the respective raised sections, each dispensing flap having weakened separation lines.

27. The lid of claim 26, wherein a portion of the weakened separation lines of said first dispensing flap forms an arcuate segment, an arcuate segment of the weakened separation lines of said second dispensing flap being opposed to the arcuate segment of the weakened separation lines of the first dispensing flap.

28. The lid of claim 16, and further including a sidewall of the bottom panel downwardly depending from the outer circumference of the bottom panel, the sidewall having an interior side.

29. The lid of claim 28, and further including a threaded connector for attaching the lid body to the beverage or food container, the threaded connector disposed in the interior side of the bottom panel sidewall.

* * * * *